US011117703B2

(12) United States Patent
Fiore, Jr.

(10) Patent No.: US 11,117,703 B2
(45) Date of Patent: Sep. 14, 2021

(54) RE-WRAP PACKAGING

(71) Applicant: Joseph Alfonse Fiore, Jr., North Hollywood, CA (US)

(72) Inventor: Joseph Alfonse Fiore, Jr., North Hollywood, CA (US)

( * ) Notice: Subject to any disclaimer, the term of this patent is extended or adjusted under 35 U.S.C. 154(b) by 0 days.

(21) Appl. No.: 16/776,542

(22) Filed: Jan. 30, 2020

(65) Prior Publication Data

US 2021/0237927 A1 Aug. 5, 2021

(51) Int. Cl.
*B65D 5/38* (2006.01)
*B65D 5/42* (2006.01)

(52) U.S. Cl.
CPC ..... *B65D 5/38* (2013.01); *B65D 5/425* (2013.01)

(58) Field of Classification Search
CPC ..... B65D 5/38; B65D 5/425; B65D 5/62
USPC ..... 229/116.5, 923, 87.19, 116.1, 125.125; 206/459.5
See application file for complete search history.

(56) References Cited

U.S. PATENT DOCUMENTS 3,684,084 A * 8/1972 Kanzelberger ..... B65D 5/38 206/773
5,183,199 A * 2/1993 Bills ..... B65D 5/322 229/122
5,234,726 A * 8/1993 Dahan ..... B42D 15/045 229/923
5,579,813 A * 12/1996 Watts ..... A63H 27/10 141/317
5,584,429 A * 12/1996 Savage ..... B65B 5/024 229/103.3
5,673,796 A * 10/1997 Tulloch ..... B65D 5/38 206/459.5
5,740,959 A * 4/1998 Savage ..... B65B 5/024 229/103.3
5,836,508 A * 11/1998 Savage ..... B65D 5/62 229/103.3
5,850,963 A * 12/1998 Chang ..... B65D 85/00 229/116.5
6,302,171 B1 * 10/2001 Watts ..... A63H 27/10 116/DIG. 9
6,405,869 B1 * 6/2002 Whittemore ..... B65D 33/004 206/497
7,866,472 B2 * 1/2011 Aylward ..... B65D 5/5088 206/457
10,150,586 B2 * 12/2018 Carden ..... B65D 5/30
2007/0063007 A1 * 3/2007 Campbell ..... B65D 5/62 229/125.21
2009/0301921 A1 * 12/2009 Kidwell ..... B65D 5/38 206/459.5
2010/0127053 A1 * 5/2010 Johnson ..... B65D 5/4262 229/87.19
2012/0043246 A1 * 2/2012 Kidwell ..... B65D 5/38 206/459.5
2013/0186782 A1 * 7/2013 Doyle ..... B65D 5/02 206/232

(Continued)

*Primary Examiner* — Christopher R Demeree

(57) ABSTRACT

The invention relates to a packaging system including box and wrapping papers of conventional type having a square folded bottom and side folds providing a box shaped assembly where the proposed assembly can be used for packaging of various types of items. The assembly is easy to use and can be used for packaging of consumer goods, gifts, surprise or mystery items, in promotional schemes or brand activation and marketing activities.

5 Claims, 5 Drawing Sheets

(56) References Cited

U.S. PATENT DOCUMENTS

2013/0270133 A1* 10/2013 Kenner ..... B65D 25/34
206/320
2020/0172285 A1* 6/2020 Tibebu ..... B65D 5/2066

* cited by examiner

RE-WRAP PACKAGING

COPYRIGHT NOTICE

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND

Field of the Invention

The invention relates to the field of packaging object (s), and more particularly packaging implemented by means of an inner box, an outer sleeve that the inside box slides into also there is a revolving paper that is connected to the back end of the inside of the box.

Description of the Related Art

For many years gifts in many different societies have been wrapped in wrapping paper. The wrapping paper is often decorated with designs or patterns indicative of the occasion for which the gift is given. The wrapping paper serves as a cheerful decoration for the gift and also as a means for temporarily concealing the gift from observation by the intended recipient. Conventional gift wrap is designed for a single use, and is usually formed of paper, although plastic and foil gift wrap are also available.

There are multiple solutions that have been presented in prior art regarding wrapping or packaging multiple articles of utility. For instance, wrap for packaging at least one object, of the type consisting of a shrinkable plastic material sleeve bearing PCT patent 2004000685A1 is issued to Eric Fresnel, Eric Fresnel. The patent discloses an invention concerns a wrap for packaging object (s), consisting of a shrinkable plastic material sleeve (11) designed to be shrunk on the packaged object, said sleeve being obtained from a film folded on itself and closed by assembling the two end zones concerned. The invention is characterized in that said two end zones (12, 13) have substantially contiguous opposite free edges (12.1, 13.1), and they are mutually assembled by an overlapping strip (15) adhering to said zones on one surface (14) of the sleeve (11) on either side of the two opposite free zones, the other surface (16) of said sleeve being then substantially smooth. Thus, it is possible to produce an internally printed recyclable shrinkable sleeve with very satisfactory appearance for its inner or outer smooth surface.

Another patent disclosing a One-step sterilization packing system bearing Japanese patent 2,004,250,108A is issued to a Japanese inventor. The patent discloses a solution aimed to provide a one-step sterilization wrapping material (10) suitable for packing, transporting and storing surgical instruments (18) and apparatuses. <P>SOLUTION: The one-step sterilization wrapping material (10) includes an internal wrap (14) and an external wrap (12) which are connected to each other, and different from conventional ones. In a conventional wrapping technique, an article to be sterilized (18) is packed in two separate wrapping sheets. The wrapping sheet is specially processed to give a special property to each sheet, next, separate wraps (20, 22) and (12, 14) to be connected to each other are provided, the article can be packed and opened by a suitable one-step process, and thereby efficiency can be increased and a cost can be reduced. In a particular case, the wrap (12) is prepared so as to increase strength, the wrap (14) is prepared so as to strengthen barrier performance, the wrap (14) and the wrap (12) are arranged so as to be visually distinguished from each other, and thereby improper packing and opening can be prevented.

An insulating packaging material and related packaging system bearing U.S. Pat. No. 7,621,404B2 is issued to Thermafreeze Products Corp, Thermafreeze Products Corp. The patent discloses an insulating packaging material is positioned around a product, including 1-ply, 2-ply, or 3-ply material. Some of the embodiments include a layer of bubble wrap material having its bubble side placed against the flat side of the adjacent ply, which can be metalized plastic film, a foam layer, or both. With such an arrangement, air pockets are formed between the bubbles and the other ply's flat surface. A separate layer of bubble wrap may be similarly placed about the interior of the box A system for delivering perishable groceries includes a box; a source of cold (or heat) maintaining the temperature inside the box within a desired temperature range, and using a pouch of packet material. Each packet may contain a super-absorbent polymer which is hydrated and then either frozen or heated, without producing moisture when thawing or cooling.

A Reusable fabric gift wrap bearing U.S. Pat. No. 5,004,144A is issued to Betty J. Selga, Betty J. Selga. The patent discloses a reusable gift wrapping is comprised of a flexible expanse of folding fabric having releasable Velcro fasteners secured to its periphery. The Velcro fasteners are engagable when the farbic is folded to envelop a carton placed within the expanse of foldable fabric. A fabric bow and a fabric card holder may also be removably attached to the expanse of foldale fabric ny means of Velcro fasteners.

A Stretchable gift wrap bearing U.S. Pat. No. 5,743,458A is issued to Judith A. French, Judith A. French. The patent discloses various embodiments of stretchable gift wrap provide for the wrapping of a portion of a regularly or irregularly shaped article to provide an attractive and closely fitting wrap therefor. The wrap is preferably formed of a finely woven, generally opaque elastic fabric material adapted to stretch to substantially twice its unstretched dimension in all directions, such as a spandex material, although other stretchable materials may be used. In one embodiment, a flat sheet with a pair of opposite elastic bands is provided, which may be stretched over a gift or article to cover the upper portion thereof. Another embodiment comprises a flat sheet with a peripheral closure band which is used to draw the wrap tightly about an article. A third embodiment comprises a sleeve of stretchable material, which may be open at one or both ends. The sleeve may be used to wrap elongate articles (wine bottles, etc.) therein, with the corners of the closed end of the sleeve being folded and gathered to form an attractive configuration. The stretchable material used in each of the embodiments may be gathered by drawing together two separate points on the material and securing them together, to form a loop. The loop may be used for the attachment of trim articles (bows, ribbons, etc.) to the wrapped article. The wrapping material may be plain or may be styled or decorated in any one of a number of patterns, as desired.

A Gift wrapping package bearing U.S. Pat. No. 4,930,903A is issued to William Maher Inc, William Maher Inc. The patent discloses a gift wrap package includes a paper bag of conventional type having a square folded bottom and side folds providing a bag of generally rectilinear shape. An insert inside the bag supports one or more of the bag sides and gives the bag the appearance of a box. A rectilinear lid closes the open mouth of the bag. In one embodiment, a pair of handles are affixed to the bag and extend through slots in the lid. In another embodiment, the handles are attached to an intermediate portion of the bag and extend alongside the lid. Suitable ribbons or bows may be applied to the package.

A Gift-wrapping storage container bearing U.S. Pat. No. 4,186,833A is issued to Virginia L. Homan, Virginia L. Homan. The patent discloses a hinged cover container having ribbon spool storage and dispensing dowels in the cover, and a divided major container portion for storage of folded paper in one section and cards and ribbons in a smaller section. The inside of the cover is provided with loops of elastic ribbon for securing hardware useful for wrapping.

There are multiple solutions that have been presented in prior art. However, these solutions are limited and restricted to their conventional single product packaging methodology and utility. Unfortunately, currently available packaging system cannot be utilized for multiple types of packaging requirements.

The current invention proposes a packaging system which is made to package many different consumer products. It is a simple and easy to use assembly which can securely keep the product inside and its packaging can be used in multiple domains which is not limited to beautification, styling, marketing of brand, wishes messages and for many other functionalities.

None of the previous inventions and patents, taken either singly or in combination, is seen to describe the instant invention as claimed. Hence, the inventor of the present invention proposes to resolve and surmount existent technical difficulties to eliminate the aforementioned shortcomings of prior art.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

The primary desirable object of the present invention is to provide a novel and improved form of a packaging system which can be used for packaging multiple array of products.

It is also the primary objective of the invention to increase the perceived value of product through its packaging.

It is further the objective of the invention which can provide packaging solution for thousands of different kinds of products like but not limited to toys, shoes, apparel, medical supplies, cellphones and many more.

It is also the objective of the invention to provide additional space for brands to add information regarding their product instead of adding booklets or leaflets with the product, which can be displaced easily.

It is further the object of the present invention to provide a packaging system which can transmit concealed messages to the user for example in case of company promotional schemes or gifts services, this packaging can be highly useful.

It is further the objective of the invention to provide aa packaging utility help to maintain and reveal the mystery or surprise gifts.

It is moreover the objective of the invention to provide a simple to use apparatus which can be installed and used easily.

Thus, it is the objective to provide a new and improved wrapping and packaging assembly which can be customized as per requirements to accommodate industries of multiple uses. Other aspects, advantages and novel features of the present invention will become apparent from the detailed description of the invention when considered in conjunction with the accompanying drawings.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
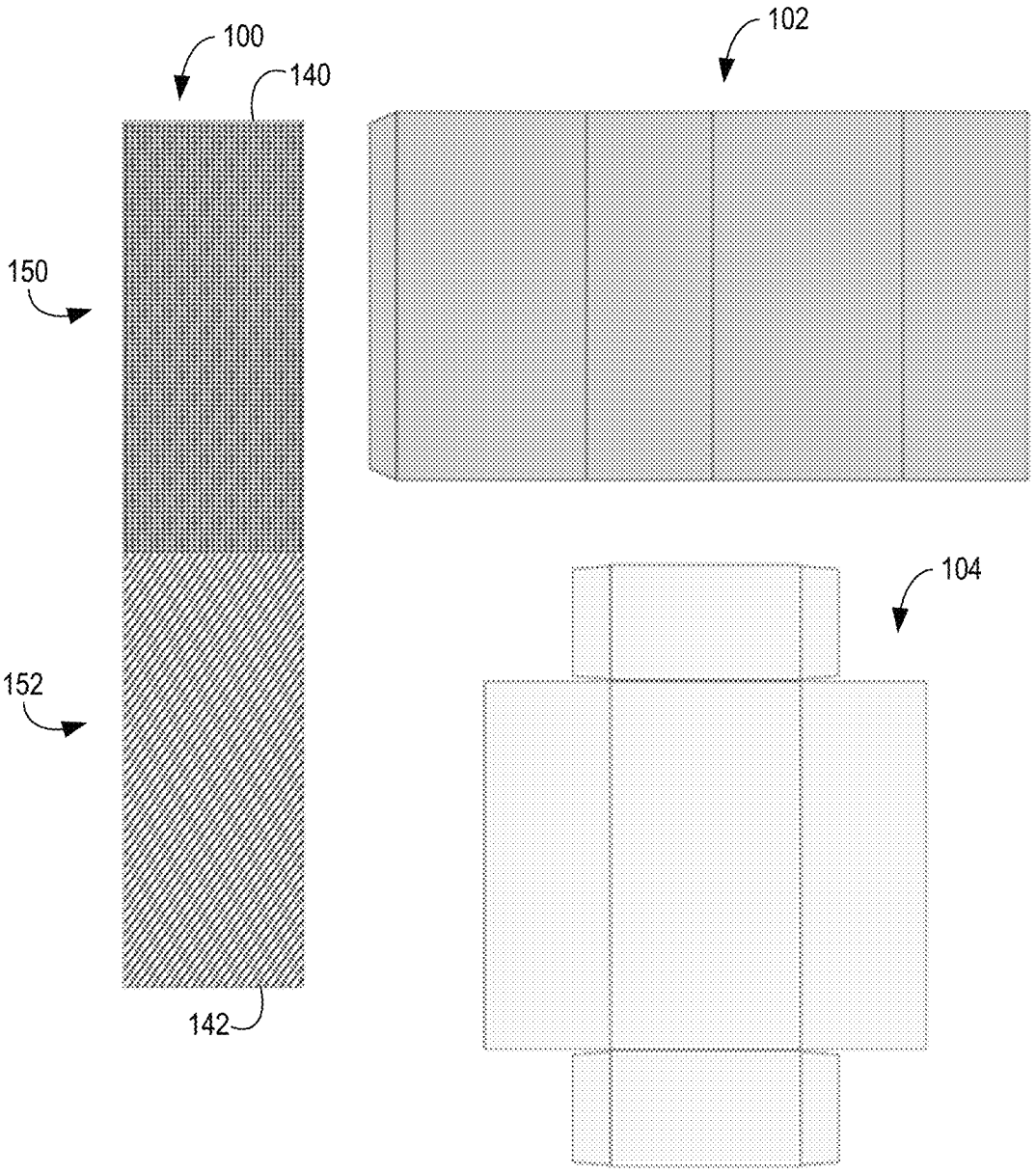
FIG. 1 is an illustration of rewrap packaging solution's wrapping, outer sleeves and inner box assembly as per exemplary embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The present invention is directed to a customized wrapping and packaging solution, which can be utilized in multiple domains and multiple industries.

The current assembly as per its preferred embodiment is made to package many different consumer products. The assembly is generally comprised of an inner box and an outer sleeve that the inside box slides into. There is a revolving paper that is connected to the back end of the inside of the box.

Further there will be 4 revolving papers; one on the top, one on the bottom, and two revolving papers on both sides of the box. The top revolving paper will be connected to the top edge of the back end of the inner box. The bottom revolving paper will be connected to the bottom edge of the back end of the inner box. The two side revolving papers will be connected to the left-side and right-side edges of the back end of the inner box.

Once the revolving papers are connected to the edges of the back end of the inner box they then go over the top of the sleeve to the end of the sleeve and then fed back through under the sleeve to connect to the same edge of the back end of the inner box.

Once user pull the front end of the inner box out, the paper revolves at the same speed that user is pulling the box in. All 4 sides will have revolving paper that will simultaneous revolve with each other. This could work for just one side of the box, just 2 sides of the box, 3 sides of the box, or revolving all 4 sides. This depends on the company's needs and what they want for their customers.

For instance, before the inner box is pulled out that the outer part of the revolving paper that is showing is red and the part of the revolving paper that is underneath the sleeve and not showing is blue. This mean that when the inner box is 0% pulled out, then the outside of the box will appear completely red.

When the user begins to pull the front end of the inner out the blue part of the revolving paper will slowing begin to show itself on one end while the red material scrolls underneath the sleeve on the opposite end. This means if user pulls the inner box 50% out, then have the box's wrap on all 4 sides will be 50% red and 50% blue. If you pull the inner box all the out to where the back end of the inner box is at the edge of the sleeve, then the whole box will be blue.

Figure 2:
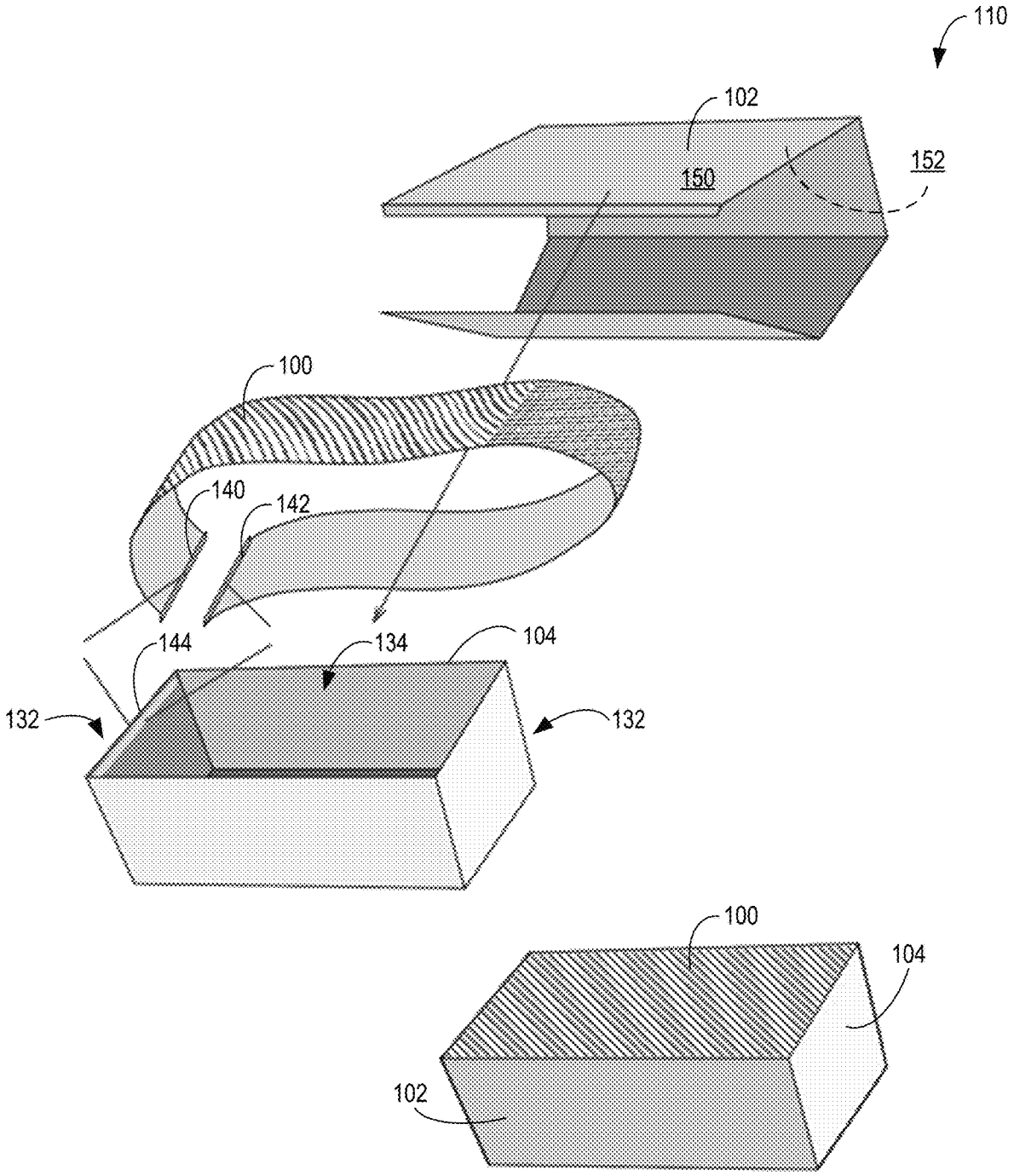
FIG. 2 is showing rewrap packaging solution assembly where outers sleeves can be constructed, consistent with the exemplary embodiments of the present invention.
Figure 3:
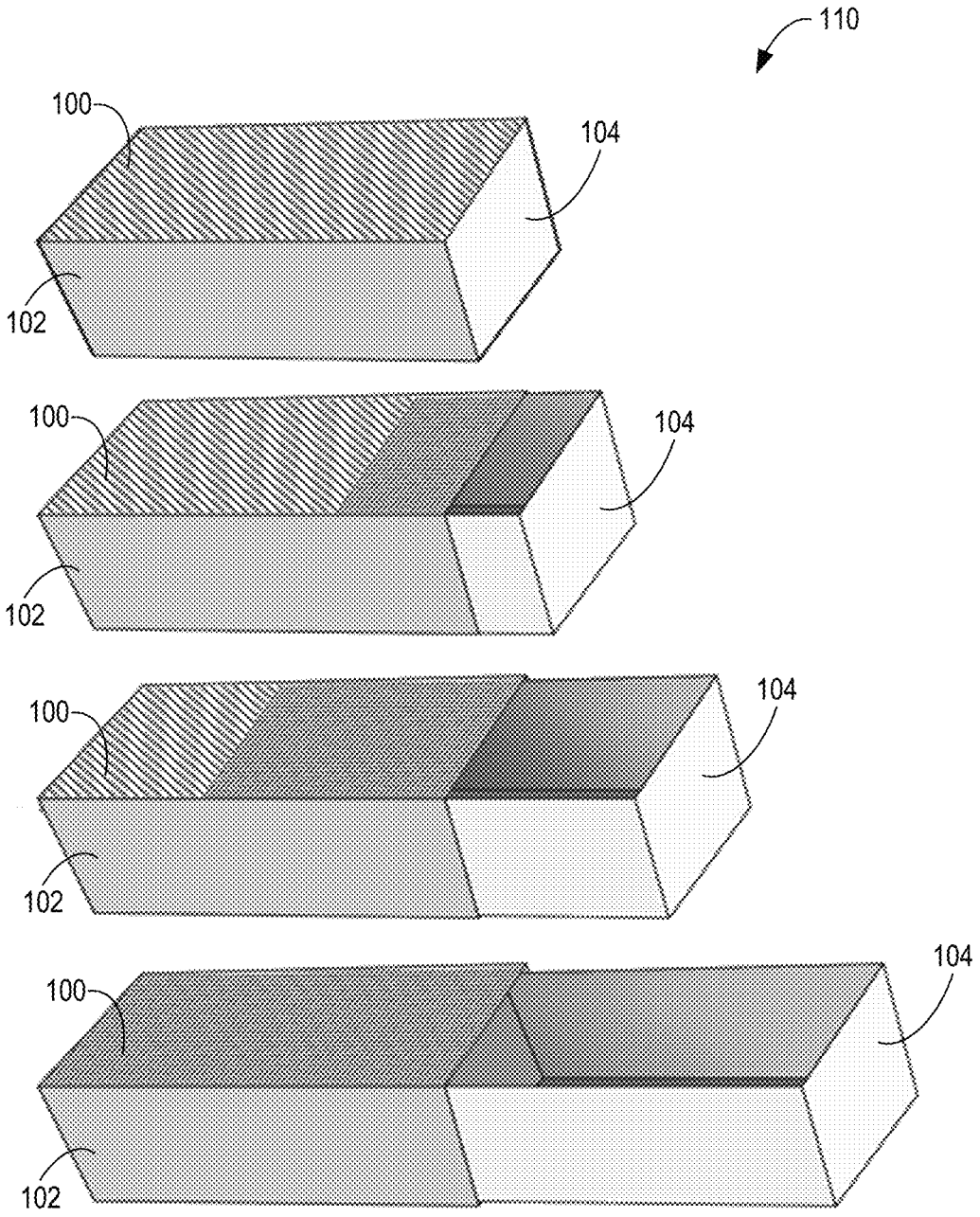
FIG. 3 is showing multiple view of the rewrap packaging assembly, consistent with the exemplary embodiments of the present invention.
Figure 4:
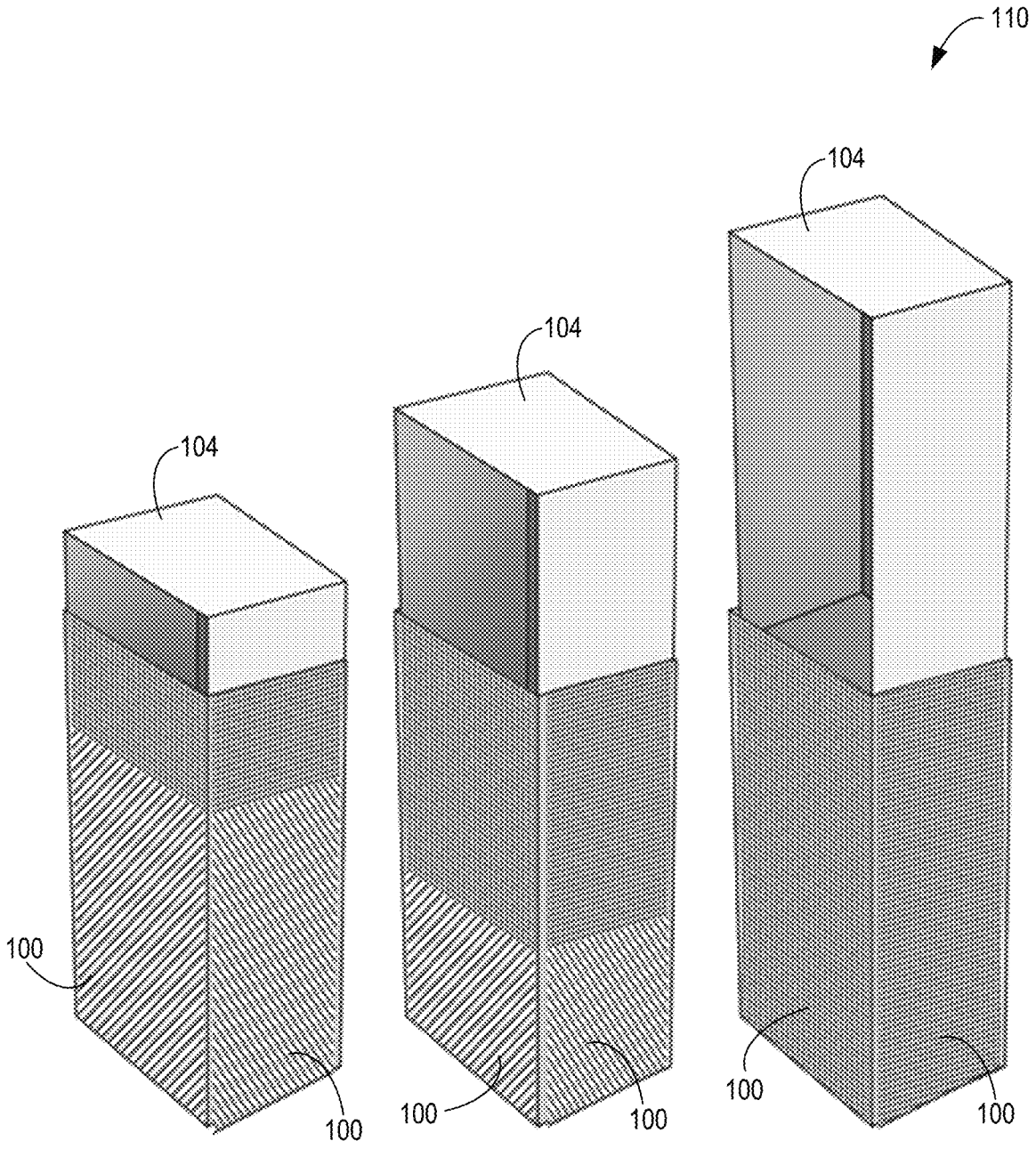
FIG. 4 is showing multiple view of the rewrap packaging assembly as per its multiple sides, consistent with the exemplary embodiments of the present invention
Figure 5:
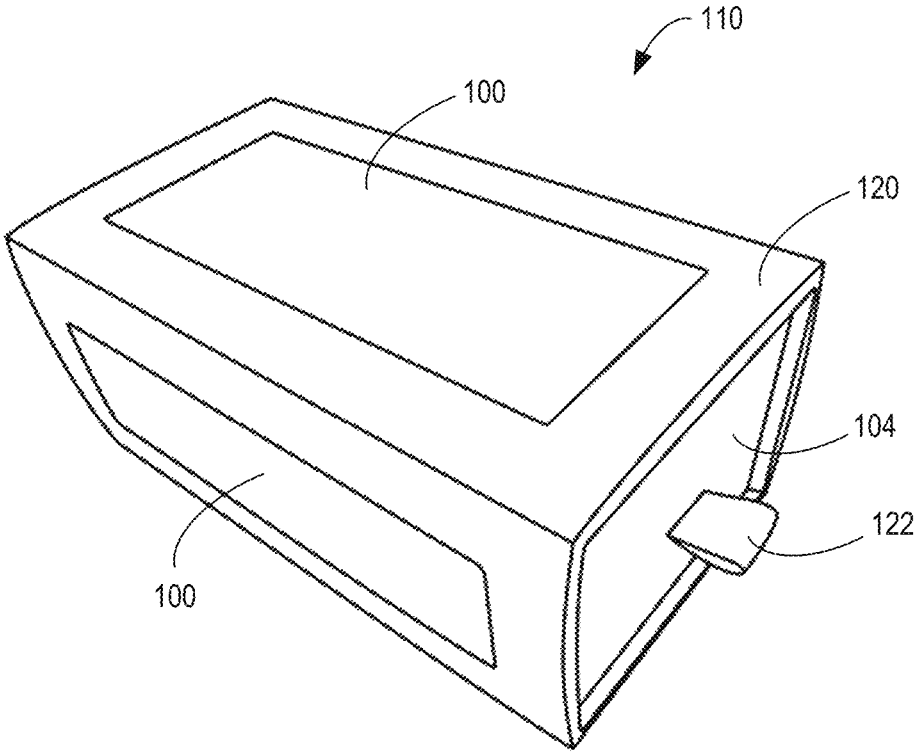
FIG. 5 is a perspective view of the invention showing the edges.

This can be further understood from the FIG. 1 which is an illustration of rewrap packaging solution's wrapping 100 (sometimes referred to as revolving paper), outer sleeves 102 and inner box 104 assembly as per exemplary embodiments of the invention. The wrapping 100 will be tightened around the outer sleeves (as shown in FIG. 21. There would be a cardboard lining for the edges to keep the paper down to and make it look cleaner. FIG. 2 depicts a rewrap packaging solution assembly 110 wherein the outer sleeves 102 can be constructed, consistent with the exemplary embodiments of the present invention. FIG. 3 depicts multiple views of the rewrap packaging assembly 110, consistent with the exemplary embodiments of the present invention. FIG. 4 depicts multiple views of the rewrap packaging assembly 110 as per its multiple sides, consistent with the exemplary embodiments of the present invention. As shown in FIGS. 1-4 the re-wrap packaging assembly 110 has an open top inner box 104 and an outer sleeve 102. The open top inner box 104 is slidingly received inside the outer sleeve 102. The open top inner box 104 comprises a first end 132 and a second end 132. A cavity 134 is defined between the first end second end. The outer sleeve 102 has an outer surface 150 and an inner surface 152. The re-wrap packaging assembly 110 has a revolving paper 100 that has a first end 140 and a second end 142. The first end 100 is connected to a top edge 144 of the first end 132 the open top inner box 104 and the second end 142 is connected to the top edge 144 of the first end 132 of the open top inner box. The revolving paper 100 wraps the outer sleeve 102 such that a first portion 150 of the revolving paper is positioned proximate the inner surface 152 of the outer sleeve 102 and a second portion 152 is positioned proximate the outer surface 150 of the outer sleeve 102. As shown in FIG. 3, subsequent to translation of the open top inner box 132 relative to the outer sleeve 102 (i.e., opening the re-wrap packaging assembly 110), the first portion 150 of the revolving paper 100 is positioned proximate the outer surface 150 of the outer sleeve 102 and the second portion 152 is position proximate the inner surface 152 of the outer sleeve 102. FIG. 5 depicts the use of a cardboard lining 120 as well as a pull tab 122 coupled to the inner box 104.

FIG. 2 is showing rewrap packaging solution assembly where outers sleeves can be constructed so that it is between wrapping, which has been glued to bottom edge of the inner box, consistent with the exemplary embodiments of the present invention.

FIG. 3 shows the inner box which will be pushed through the outer sleeves, wrapping will slide along outer sleeves wall to show the other half of wrapping previously hidden.

FIG. 4 is showing multiple view of the rewrap packaging assembly as per its multiple sides, consistent with the exemplary embodiments of the present invention. There would be a cardboard lining for the edges to keep the paper down to and make it look cleaner.

FIG. 5 is a perspective view of the invention showing the edges.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A re-wrap packaging assembly, comprising:

an open top inner box and an outer sleeve, wherein the open top inner box is slidingly received inside the outer sleeve, a revolving paper having a first end that is connected to a top edge of the open top inner box and a second end connected to the top edge of the open top inner box, wherein the revolving paper extends from the connection of the first end to the top edge over a top of the outer sleeve, wraps around an end of the outer sleeve, and feeds back under the outer sleeve to the connection of the second end to the first end of the top edge.

2. The re-wrap packaging assembly of claim 1, further comprising a pull tab coupled to the open top inner box.

3. The re-wrap packaging assembly of claim 1, further comprising at least two revolving papers, wherein the top inner box comprises a first side and a second side, and wherein a first of the two revolving papers is positioned on the first side and a second of the two revolving papers is positioned on the second side.

4. The re-wrap packaging assembly of claim 1, wherein during translation of the open top inner box relative to the outer sleeve, the revolving paper moves relative to the outer sleeve.

5. A re-wrap packaging assembly, comprising:

an open top inner box and an outer sleeve, wherein the open top inner box is slidingly received inside the outer sleeve, wherein the open top inner box comprises a first end and a second end, wherein a cavity is defined between the first end second end, and wherein the outer sleeve has an outer surface and an inner surface, a revolving paper having a first end and a second end, wherein the first end is connected to a top edge of the first end of the open top inner box, wherein the second end is connected to the top edge of the first end of the open top inner box, wherein the revolving paper wraps the outer sleeve such that a first portion of the revolving paper is positioned proximate the inner surface of the outer sleeve and a second portion is positioned proximate the outer surface of the outer sleeve, and wherein subsequent to translation of the open top inner box relative to the outer sleeve, the first portion of the revolving paper is positioned proximate the outer surface of the outer sleeve and the second portion is positioned proximate the inner surface of the outer sleeve.

* * * * *